US009420372B2

(12) United States Patent
Kordon et al.

(10) Patent No.: US 9,420,372 B2
(45) Date of Patent: Aug. 16, 2016

(54) METHOD AND APPARATUS FOR PROCESSING SIGNALS OF A SPHERICAL MICROPHONE ARRAY ON A RIGID SPHERE USED FOR GENERATING AN AMBISONICS REPRESENTATION OF THE SOUND FIELD

(71) Applicant: THOMSON LICENSING, Issy de Moulineaux (FR)

(72) Inventors: Sven Kordon, Wunstorf (DE); Johann-Markus Batke, Hannover (DE); Alexander Krueger, Hannover (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/356,265

(22) PCT Filed: Oct. 31, 2012

(86) PCT No.: PCT/EP2012/071537
§ 371 (c)(1),
(2) Date: May 5, 2014

(87) PCT Pub. No.: WO2013/068284
PCT Pub. Date: May 16, 2013

(65) Prior Publication Data

US 2014/0307894 A1 Oct. 16, 2014

(30) Foreign Application Priority Data

Nov. 11, 2011 (EP) ..... 11306472

(51) Int. Cl.
*H04R 3/00* (2006.01)
*H04R 25/00* (2006.01)
(Continued)

(52) U.S. Cl.
CPC ..... *H04R 3/005* (2013.01); *H04R 1/326* (2013.01); *H04R 1/406* (2013.01); *H04R 5/027* (2013.01); *H04R 29/005* (2013.01); *H04R 2201/401* (2013.01); *H04S 2400/15* (2013.01)

(58) Field of Classification Search
None
See application file for complete search history.

(56) References Cited

U.S. PATENT DOCUMENTS

2003/0016835 A1 1/2003 Elko et al.
2003/0147539 A1* 8/2003 Elko et al. ..... 381/92
(Continued)

FOREIGN PATENT DOCUMENTS

EP 1737271 A1 12/2006
EP 2592845 5/2013

OTHER PUBLICATIONS

Moreau, Daniel Bertet: "3D Sound Field Recording with Higher Order Ambisonics Objective Measurements and Validation of Spherical Microphone"; Audio Engineering Society, May 20-23, 2006.

(Continued)

*Primary Examiner* — Andrew L Sniezek

(57) ABSTRACT

Spherical microphone arrays capture a three-dimensional sound field ($P(\Omega_c,t)$ for generating an Ambisonics representation ($A_n^m(t)$), where the pressure distribution on the surface of the sphere is sampled by the capsules of the array. The impact of the microphones on the captured sound field is removed using the inverse microphone transfer function. The equalization of the transfer function of the microphone array is a big problem because the reciprocal of the transfer function causes high gains for small values in the transfer function and these small values are affected by transducer noise. The invention estimates (73) the signal-to-noise ratio between the average sound field power and the noise power from the microphone array capsules, computes (74) the average spatial signal power at the point of origin for a diffuse sound field, and designs in the frequency domain the frequency response of the equalization filter from the square root of the fraction of a given reference power and the simulated power at the point of origin.

10 Claims, 5 Drawing Sheets

Figure 1:
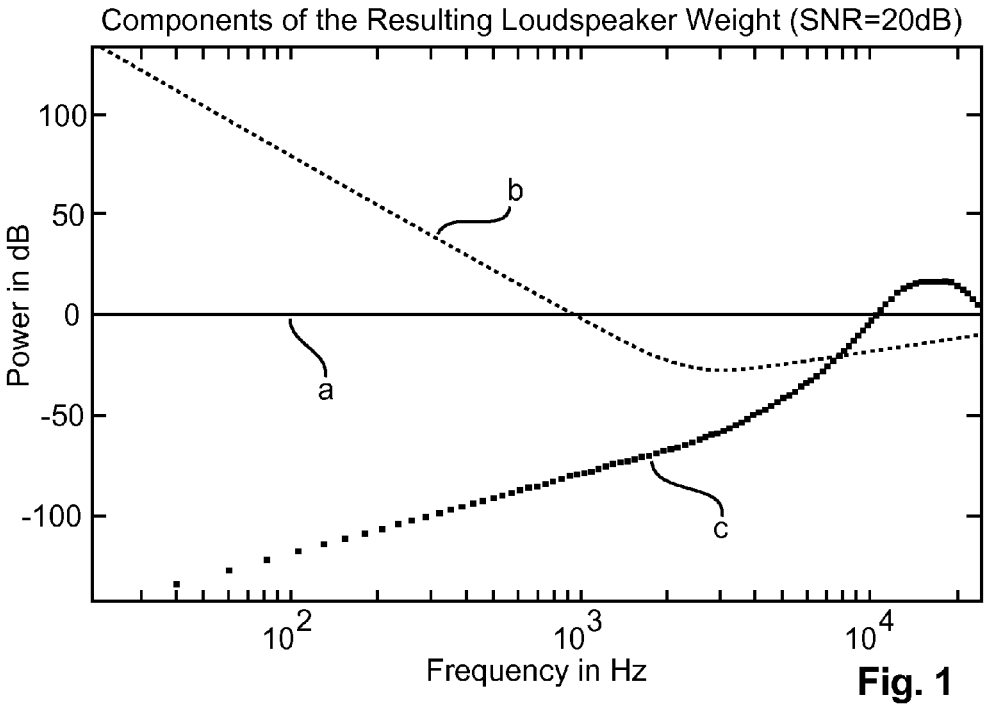

(51) Int. Cl.

| | |
|---|---|
| ***H04R 1/32*** | (2006.01) |
| *H04R 29/00* | (2006.01) |
| *H04R 1/40* | (2006.01) |
| *H04R 5/027* | (2006.01) |

(56) References Cited

U.S. PATENT DOCUMENTS

| | | | | |
|---|---|---|---|---|
| 2004/0247134 | A1* | 12/2004 | Miller, III | 381/19 |
| 2010/0008517 | A1 | 1/2010 | Elko et al. | |
| 2010/0142732 | A1 | 6/2010 | Craven et al. | |
| 2012/0093344 | A1* | 4/2012 | Sun et al. | 381/122 |
| 2014/0270245 | A1* | 9/2014 | Elko et al. | 381/92 |
| 2014/0286493 | A1* | 9/2014 | Kordon et al. | 381/26 |

OTHER PUBLICATIONS

Search Report Dated Dec. 14, 2012.

Poletti "Three-Dimensional Surround Sound Systems Based on Spherical Harmonics", J. Audio Eng. Soc., vol. 53, No. 11, pp. 1004-1025, Nov. 1, 2005.

Agmon and Rafaely. Beamforming for a Spherical-Aperture Microphone. IEEE!, pp. 227-230, Jan. 1, 2008.

Batke et al "Using VBAP-derived panning functions for 3D ambisonics decoding." Proc. of the 2nd International Symposium on Ambisonics and Spherical Acoustics, Paris, France, May 6, 2010.

Rafaely "Plane-wave Decomposition of the Sound Field on a Sphere by Spherical Convolution". J. Acoust. Soc. Am., 4(116):2149-2157, Jan. 1, 2004.

Fliege et al "A Two-Stage Approach for Computing Cubature Formulae for the Sphere", Technical report, Fachbereich Mathematik, Universitat Dortmund, Jan. 1, 1999. Node numbers are found at http://www.mathematik.uni-dortmund.de/lsx/research/projects/fliege/nodes/nodes.html.

Zotter "Sampling strategies for holography/holophony on the sphere", Proceedings of the NAG-DAGA, Rotterdam, Jan. 1, 2009.

Boaz etal_Analysis and design of spherical microphone arrays, IEEE vol. 13, No. 1, 2005.

Shefeng Yan etal, Optimal modal beamforming for spherical microphone arrays, III, vol. 19, No. 2, 2011.

Morag Agmon etal, Maximum Directivity beamformer for pherical-aperture microphones, IEEE Workshop on applications of signal processing to audio and acoustics, Oct. 18-21, 2009, New Paltz, NY, USA.

Earl G. Williams "Fourier Acoustics" Academic Press, Chapter 6, Spherical Waves, pp. 183-196; Jan. 1, 1999.

Anonymous, mh acoustics Homepage, online retrieved from: http://www.mhacoustics.com, viewed on: Feb. 1, 2007.

* cited by examiner

METHOD AND APPARATUS FOR PROCESSING SIGNALS OF A SPHERICAL MICROPHONE ARRAY ON A RIGID SPHERE USED FOR GENERATING AN AMBISONICS REPRESENTATION OF THE SOUND FIELD

This application claims the benefit, under 35 U.S.C. §365 of International Application PCT/EP2012/071537, filed Oct. 31, 2012, which was published in accordance with PCT Article 21(2) on May 16, 2013 in English and which claims the benefit of European patent application No. 11306472.9, filed Nov. 11, 2011.

The present principles relate to a method and to an apparatus for processing signals of a spherical microphone array on a rigid sphere used for generating an Ambisonics representation of the sound field, wherein an equalization filter is applied to the inverse microphone array response.

BACKGROUND

Spherical microphone arrays offer the ability to capture a three-dimensional sound field. One way to store and process the sound field is the Ambisonics representation. Ambisonics uses orthonormal spherical functions for describing the sound field in the area around the point of origin, also known as the sweet spot. The accuracy of that description is determined by the Ambisonics order N, where a finite number of Ambisonics coefficients describes the sound field. The maximal Ambisonics order of a spherical array is limited by the number of microphone capsules, which number must be equal to or greater than the number $0=(N+1)^2$ of Ambisonics coefficients.

One advantage of the Ambisonics representation is that the reproduction of the sound field can be adapted individually to any given loudspeaker arrangement. Furthermore, this representation enables the simulation of different microphone characteristics using beam forming techniques at the post production.

The B-format is one known example of Ambisonics. A B-format microphone requires four capsules on a tetrahedron to capture the sound field with an Ambisonics order of one.

Ambisonics of an order greater than one is called Higher Order Ambisonics (HOA), and HOA microphones are typically spherical microphone arrays on a rigid sphere, for example the Eigenmike of mhAcoustics. For the Ambisonics processing the pressure distribution on the surface of the sphere is sampled by the capsules of the array. The sampled pressure is then converted to the Ambisonics representation. Such Ambisonics representation describes the sound field, but including the impact of the microphone array. The impact of the microphones on the captured sound field is removed using the inverse microphone array response, which transforms the sound field of a plane wave to the pressure measured at the microphone capsules. It simulates the directivity of the capsules and the interference of the microphone array with the sound field.

The distorted spectral power of a reconstructed Ambisonics signal captured by a spherical microphone array should be equalized. On one hand, that distortion is caused by the spatial aliasing signal power. On the other hand, due to the noise reduction for spherical microphone arrays on a rigid sphere, higher order coefficients are missing in the spherical harmonics representation, and these missing coefficients unbalance the spectral power spectrum of the reconstructed signal, especially for beam forming applications.

A problem to be solved by the present principles is to reduce the distortion of the spectral power of a reconstructed Ambisonics signal captured by a spherical microphone array, and to equalize the spectral power. This problem is solved by the method disclosed in claim 1. An apparatus that utilizes this method is disclosed in claim 2.

The inventive processing serves for determining a filter that balances the frequency spectrum of the reconstructed Ambisonics signal. The signal power of the filtered and reconstructed Ambisonics signal is analysed, whereby the impact of the average spatial aliasing power and the missing higher order Ambisonics coefficients is described for Ambisonics decoding and beam forming applications. From these results an easy-to-use equalization filter is derived that balances the average frequency spectrum of the reconstructed Ambisonics signal: dependent on the used decoding coefficients and the signal-to-noise ratio SNR of the recording, the average power at the point of origin is estimated.

The equalization filter is obtained from:

- Estimation of the signal-to-noise ratio between the average sound field power and the noise power from the microphone array capsules.
- Computation per wave number k of the average spatial signal power at the point of origin for a diffuse sound field. That simulation comprises all signal power components (reference, aliasing and noise).
- The frequency response of the equalization filter is formed from the square root of the fraction of a given reference power and the computed average spatial signal power at the point of origin.
- Multiplication (per wave number k) of the frequency response of the equalization filter by the transfer function (for each order n at discrete finite wave numbers k) of a noise minimizing filter derived from the signal-to-noise ratio estimation and by the inverse transfer function of the microphone array, in order to get an adapted transfer function $F_{n,array}(k)$.

The resulting filter is applied to the spherical harmonics representation of the recorded sound field, or to the reconstructed signals. The design of such filter is highly computational complex. Advantageously, the computational complex processing can be reduced by using the computation of constant filter design parameters. These parameters are constant for a given microphone array and can be stored in a look-up table. This facilitates a time-variant adaptive filter design with a manageable computational complexity. Advantageously, the filter removes the raised average signal power at high frequencies. Furthermore, the filter balances the frequency response of a beam forming decoder in the spherical harmonics representation at low frequencies. Without usage of the inventive filter the reconstructed sound from a spherical microphone array recording sounds unbalanced because the power of the recorded sound field is not reconstructed correctly in all frequency sub-bands.

In principle, the inventive method is suited for processing microphone capsule signals of a spherical microphone array on a rigid sphere, said method including the steps:

- converting said microphone capsule signals representing the pressure on the surface of said microphone array to a spherical harmonics or Ambisonics representation $A_n^m(t)$;
- computing per wave number k an estimation of the time-variant signal-to-noise ratio SNR(k) of said microphone capsule signals, using the average source power $|P_0(k)|^2$ of the plane wave recorded from said microphone array and the corresponding noise power $|P_{noise}(k)|_2$ representing the spatially uncorrelated noise produced by analog processing in said microphone array;

computing per wave number k the average spatial signal power at the point of origin for a diffuse sound field, using reference, aliasing and noise signal power components, and forming the frequency response of an equalization filter from the square root of the fraction of a given reference power and said average spatial signal power at the point of origin, and multiplying per wave number k said frequency response of said equalization filter by the transfer function, for each order n at discrete finite wave numbers k, of a noise minimizing filter derived from said signal-to-noise ratio estimation SNR(k), and by the inverse transfer function of said microphone array, in order to get an adapted transfer function $F_{n,array}(k)$;

applying said adapted transfer function $F_{n,array}(k)$ to said spherical harmonics representation $A_n^m(t)$ using a linear filter processing, resulting in adapted directional coefficients $d_n^m(t)$.

In principle the inventive apparatus is suited for processing microphone capsule signals of a spherical microphone array on a rigid sphere, said apparatus including:

means for converting said microphone capsule signals representing the pressure on the surface of said microphone array to a spherical harmonics or Ambisonics representation $A_n^m(t)$;

means for computing per wave number k an estimation of the time-variant signal-to-noise ratio SNR(k) of said microphone capsule signals, using the average source power $|P_0(k)|^2$ of the plane wave recorded from said microphone array and the corresponding noise power $|P_{noise}(k)|^2$ representing the spatially uncorrelated noise produced by analog processing in said microphone array;

means for computing per wave number k the average spatial signal power at the point of origin for a diffuse sound field, using reference, aliasing and noise signal power components, and for forming the frequency response of an equalization filter from the square root of the fraction of a given reference power and said average spatial signal power at the point of origin, and for multiplying per wave number k said frequency response of said equalization filter by the transfer function, for each order n at discrete finite wave numbers k, of a noise minimizing filter derived from said signal-to-noise ratio estimation SNR(k), and by the inverse transfer function of said microphone array, in order to get an adapted transfer function $F_{n,array}(k)$;

means for applying said adapted transfer function $F_{n,array}(k)$ to said spherical harmonics representation $A_n^m(t)$ using a linear filter processing, resulting in adapted directional coefficients $d_n^m(t)$.

Advantageous additional embodiments of the present principles are disclosed in the respective dependent claims.

DRAWINGS

Figure 2:
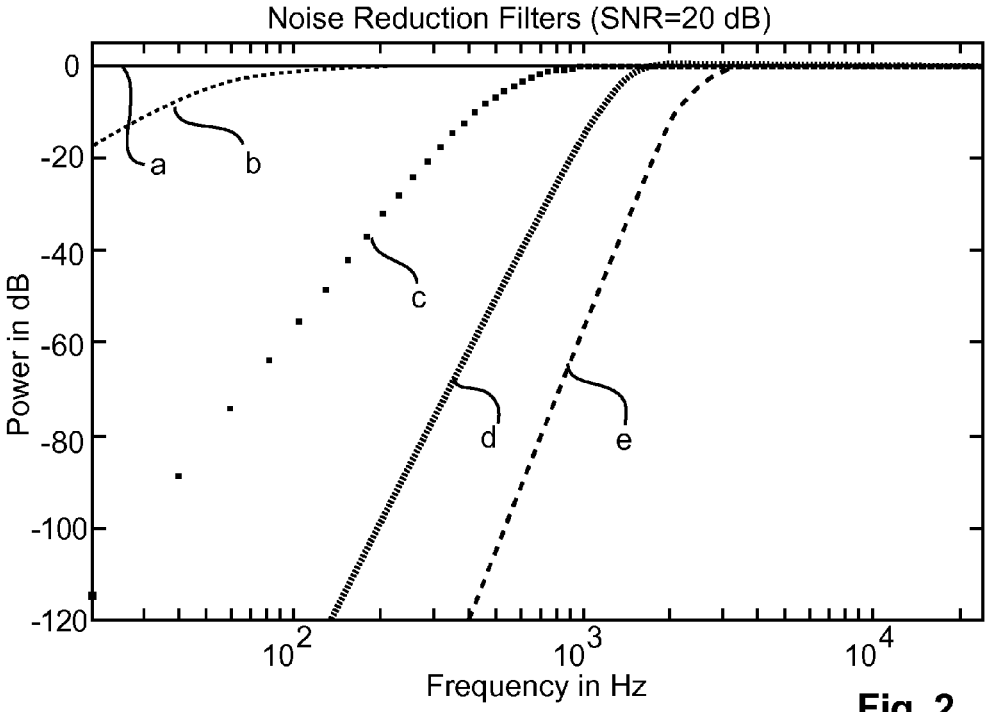
Figure 3:
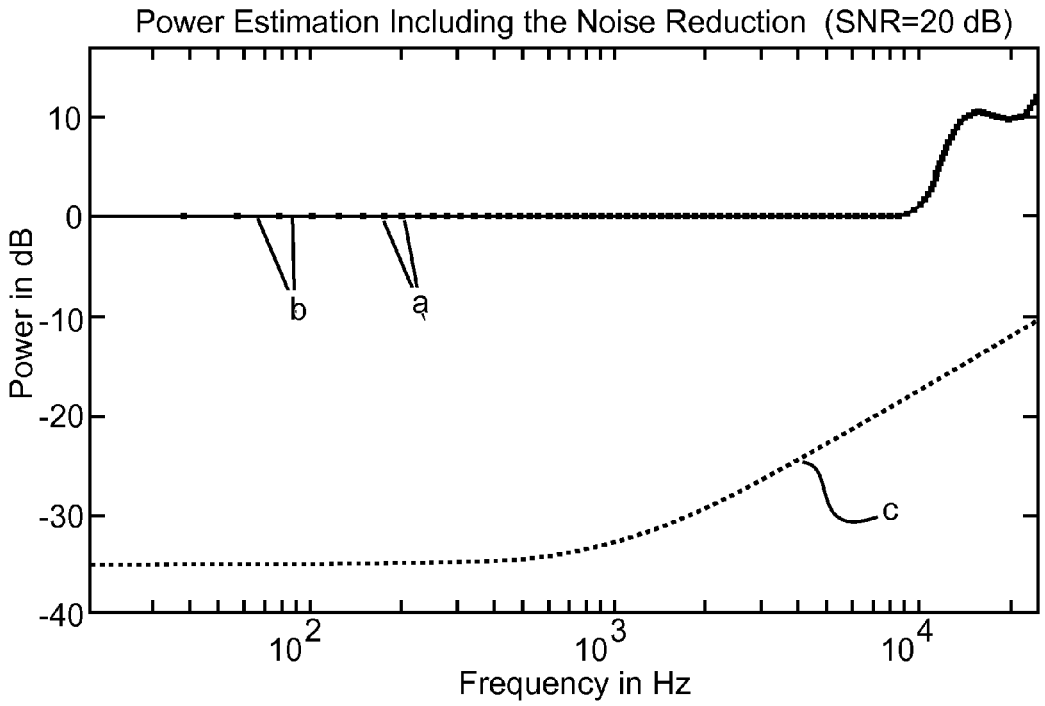
Figure 4:
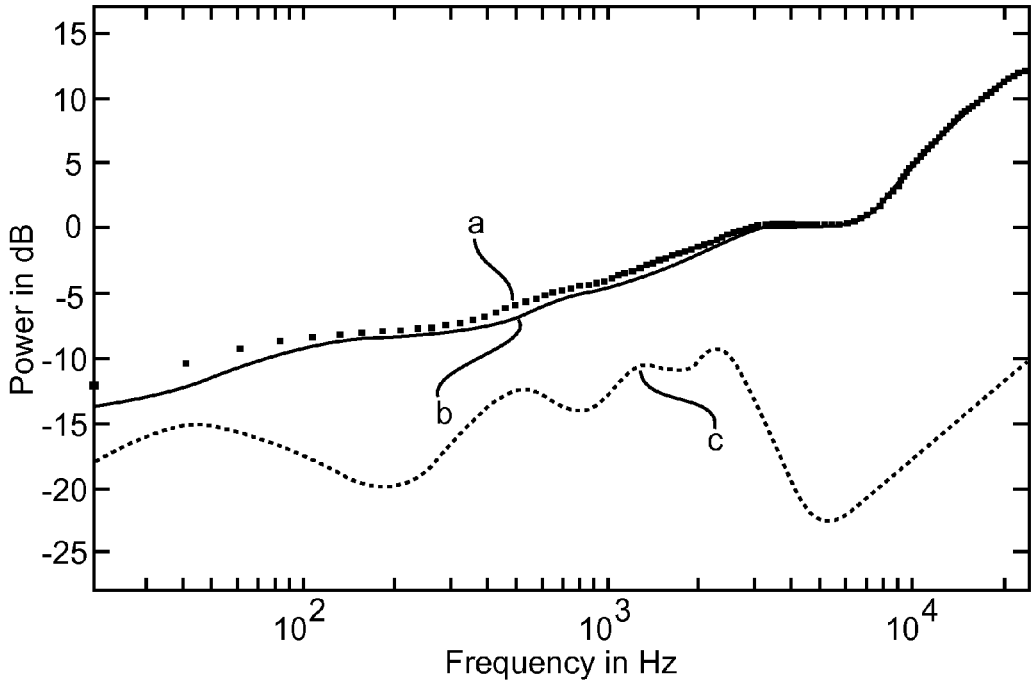
Figure 5:
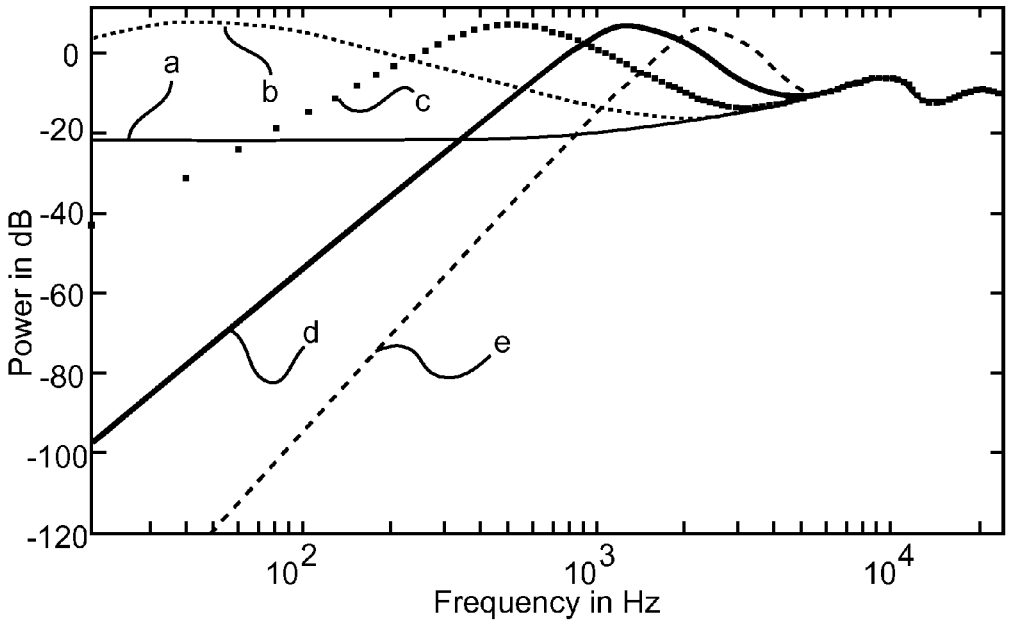
Figure 6:
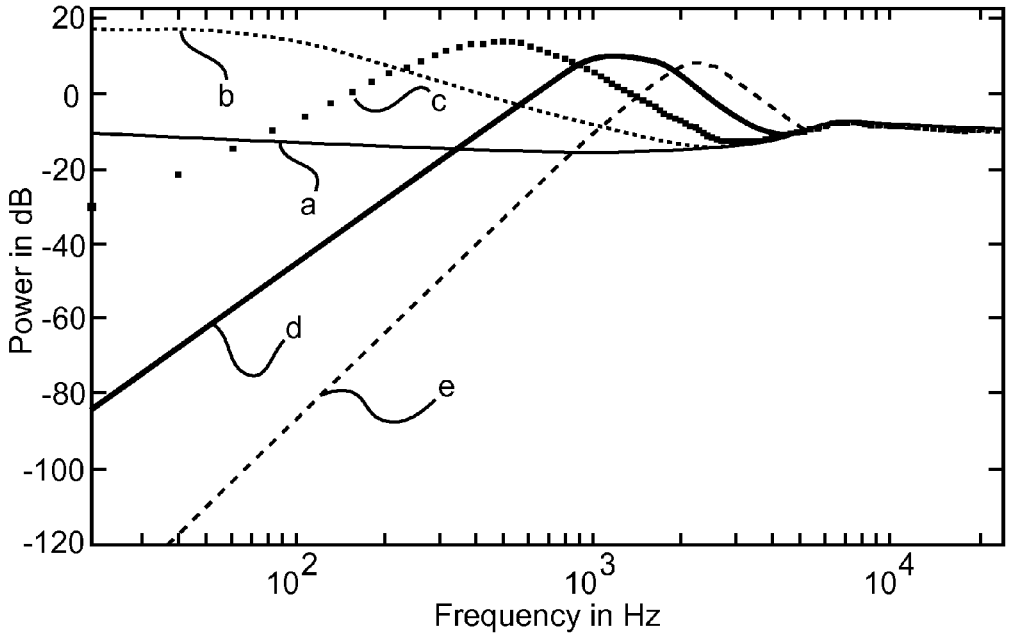
Figure 7:
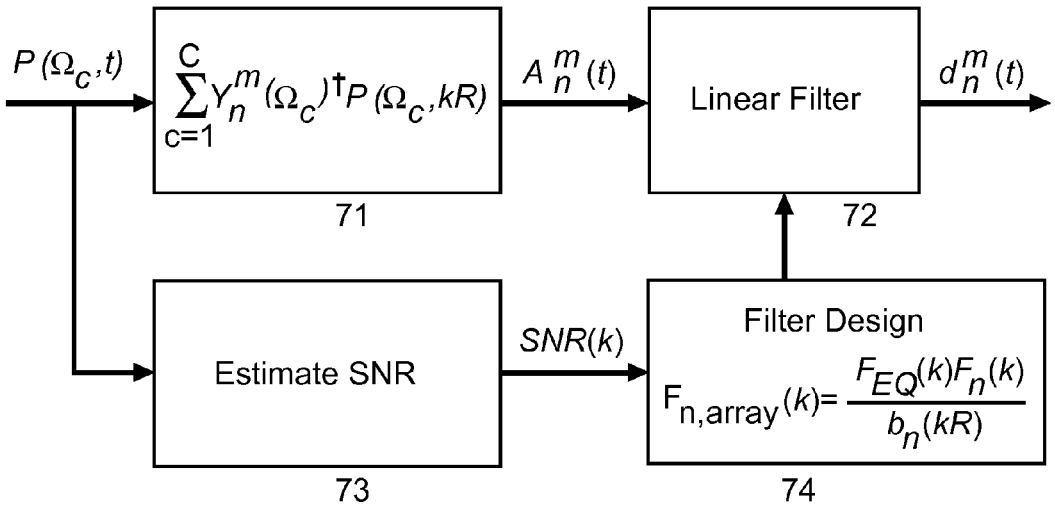
Figure 8:
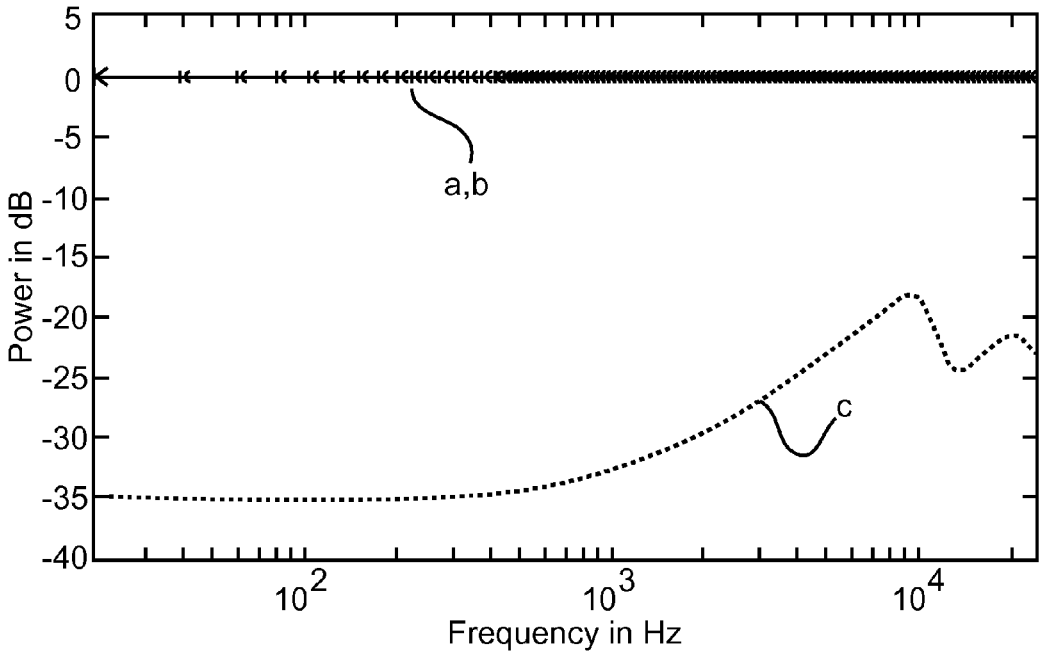
Figure 9:
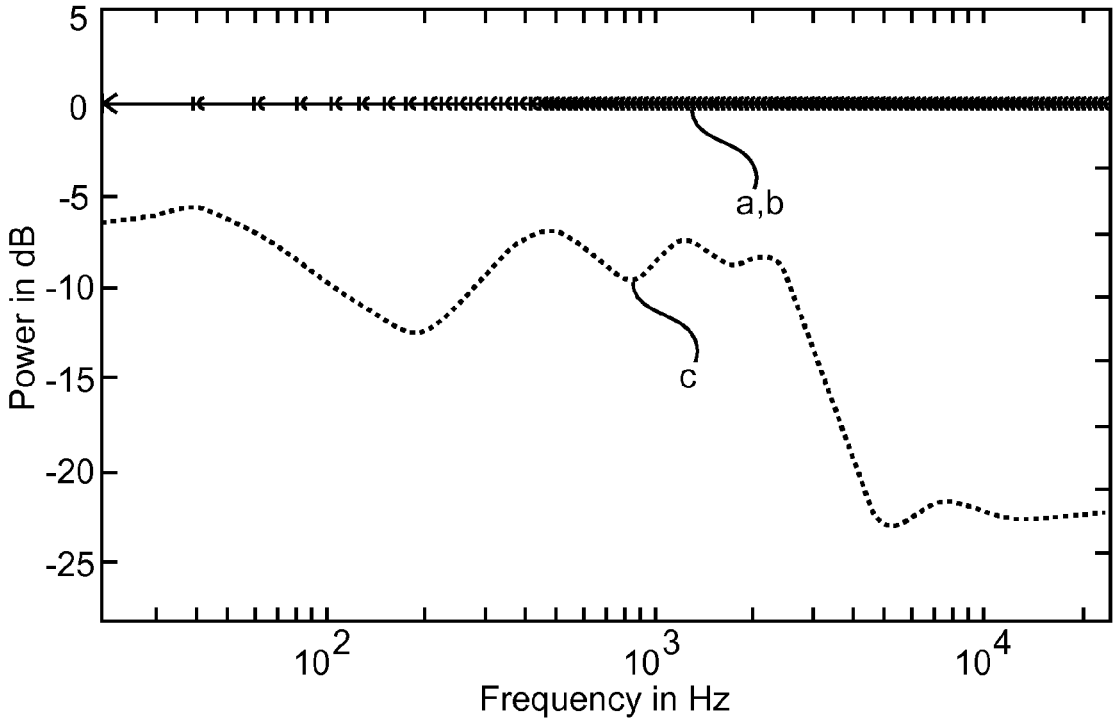

Exemplary embodiments of the present principles are described with reference to the accompanying drawings, which show in:

FIG. 1 power of reference, aliasing and noise components from the resulting loudspeaker weight for a microphone array with 32 capsules on a rigid sphere;

FIG. 2 noise reduction filter for SNR(k)=20 dB;

FIG. 3 average power of weight components following the optimization filter of FIG. 2, using a conventional Ambisonics decoder;

FIG. 4 average power of the weight components after the noise optimization filter has been applied using beam forming, where $D_n^m(\Omega_l)=Y_n^m(\Omega_{[0,0]^T})$;

FIG. 5 optimized array response for a conventional Ambisonics decoder and an SNR(k) of 20 dB;

FIG. 6 optimized array response for a beam forming decoder and an SNR(k) of 20 dB;

FIG. 7 block diagram for the adaptive Ambisonics processing according to the present principles;

FIG. 8 average power of the resulting weight after the noise optimization filter $F_n(k)$ and the filter $F_{EQ}(k)$ have been applied, using conventional Ambisonics decoding, whereby the power of the optimized weight, the reference weight and the noise weight are compared;

FIG. 9 average power of the weight components after the noise optimization filter $F_n(k)$ and the filter $F_{EQ}(k)$ have been applied, using a beam forming decoder, where $D_n^m(\Omega_l)=Y_n^m(\Omega_{[0,0]^T})$, and whereby the power of the optimized weight, the reference weight and the noise weight are compared.

EXEMPLARY EMBODIMENTS

Spherical Microphone Array Processing—Ambisonics Theory

Ambisonics decoding is defined by assuming loudspeakers that are radiating the sound field of a plane wave, cf. M. A. Poletti, "Three-Dimensional Surround Sound Systems Based on Spherical Harmonics", Journal Audio Engineering Society, vol.53, no.11, pages 1004-1025, 2005:

$$w(\Omega_l,k)=\Sigma_{n=0}^{N}\Sigma_{m=-n}^{n}D_n^m(\Omega_l)d_n^m(k) \tag{1}$$

The arrangement of L loudspeakers reconstructs the three-dimensional sound field stored in the Ambisonics coefficients $d_n^m(k)$. The processing is carried out separately for each wave number $$k=\frac{2\pi f}{c_{sound}}, \tag{2}$$

where f is the frequency and $c_{sound}$ is the speed of sound. Index n runs from 0 to the finite order N, whereas index m runs from −n to n for each index n. The total number of coefficients is therefore $0=(N+1)^2$. The loudspeaker position is defined by the direction vector $\Omega_l=[\Theta_l,\Phi_l]^T$ in spherical coordinates, and $[\bullet]^T$ denotes the transposed version of a vector.

Equation (1) defines the conversion of the Ambisonics coefficients $d_n^m(k)$ to the loudspeaker weights $w(\Omega_1,k)$. These weights are the driving functions of the loudspeakers. The superposition of all speaker weights reconstructs the sound field.

The decoding coefficients $D_n^m(\Omega_l)$ are describing the general Ambisonics decoding processing. This includes the conjugated complex coefficients of a beam pattern as shown in section 3 ($\omega^*_{nm}$) in Morag Agmon, Boaz Rafaely, "Beamforming for a Spherical-Aperture Microphone", IEEEI, pages 227-230, 2008, as well as the rows of the mode matching decoding matrix given in the above-mentioned M. A. Poletti article in section 3.2. A different way of processing, described in section 4 in Johann-Markus Batke, Florian Keiler, "Using VBAP-Derived Panning Functions for 3D Ambisonics Decoding", Proc. of the 2nd International Symposium on Ambisonics and Spherical Acoustics, 6-7 May 2010, Paris, France, uses vector based amplitude panning for computing a decoding matrix for an arbitrary three-dimensional loudspeaker arrangement. The row elements of these matrices are also described by the coefficients $D_n^m(\Omega_l)$.

The Ambisonics coefficients $d_n^m(k)$ can always be decomposed into a superposition of plane waves, as described in section 3 in Boaz Rafaely, "Plane-wave decomposition of the sound field on a sphere by spherical convolution", J. Acoustical Society of America, vol.116, no.4, pages 2149-2157, 2004. Therefore the analysis can be limited to the coefficients of a plane wave impinging from a direction $\Omega_s$:

$$d_{n_{plane}}^m(k)=P_0(k)Y_n^m(\Omega_s)^* \tag{3}$$

The coefficients of a plane wave $d_{n_{plane}}^m(k)$ are defined for the assumption of loudspeakers that are radiating the sound field of a plane wave. The pressure at the point of origin is defined by $P_0(k)$ for the wave number k. The conjugated complex spherical harmonics $Y_n^m(\Omega_s)^*$ denote the directional coefficients of a plane wave. The definition of the spherical harmonics $Y_n^m(\Omega_s)$ given in the above-mentioned M. A. Poletti article is used.

The spherical harmonics are the orthonormal base functions of the Ambisonics representations and satisfy $$\delta_{n-n}\delta_{m-m'}=\int_{\Omega\in S^2}Y_n^m(\Omega)Y_{n'}^{m'}(\Omega)\mathbf{8}d\Omega, \tag{4}$$

where $$\delta_q=\begin{cases}1, & \text{for } q=0\\ 0, & \text{else}\end{cases}$$

is the delta impulse.

A spherical microphone array samples the pressure on the surface of the sphere, wherein the number of sampling points must be equal to or greater than the number $0=(N+1)^2$ of Ambisonics coefficients. For an Ambisonics order of N. Furthermore, the sampling points have to be uniformly distributed over the surface of the sphere, where an optimal distribution of 0 points is exactly known only for order N=1. For higher orders good approximations of the sampling of the sphere are existing, cf. the mh acoustics homepage http://www.mhacoustics.com, visited on 1 Feb. 2007, and F. Zotter, "Sampling Strategies for Acoustic Holography/Holophony on the Sphere", Proceedings of the NAG-DAGA, 23-26 Mar. 2009, Rotterdam.

For optimal sampling points $\Omega_c$, the integral from equation (4) is equivalent to the discrete sum from equation (6):

$$\delta_{n-n'}\delta_{m-m'}=\frac{4\pi}{C}\sum_{c=1}^{C}Y_n^m(\Omega_c)Y_{n'}^{m'}(\Omega_c)^*, \tag{6}$$

with $n'\le N$ and $n\le N$ for $C\ge(N+1)^2$, C being the total number of capsules.

In order to achieve stable results for non-optimum sampling points, the conjugated complex spherical harmonics can be replaced by the columns of the pseudo-inverse matrix $\underline{Y}^\dagger$, which is obtained from the L×0 spherical harmonics matrix $\underline{Y}$, where the 0 coefficients of the spherical harmonics $Y_n^m(\Omega_c)$ are the row-elements of $\underline{Y}$, cf. section 3.2.2 in the above-mentioned Moreau/Daniel/Bertet article:

$$\underline{Y}^\dagger=(\underline{Y}^H\underline{Y})^{-1}\underline{Y}^H. \tag{7}$$

In the following it is defined that the column elements of $\underline{Y}^\dagger$ are denoted $Y_n^m(\Omega_c)^\dagger$, so that the orthonormal condition from equation (6) is also satisfied for $$\delta_{n-n}\delta_{m-m'}=\Sigma_{c=1}^{c}Y_n^m(\Omega_c)Y_{n'}^{m'}(\Omega_c)^\dagger \tag{8}$$

with $n'\le N$ and $n\le N$ for $C\ge(N+1)^2$.

If it is assumed that the spherical microphone array has nearly uniformly distributed capsules on the surface of a sphere and that the number of capsules is greater than 0, then $$Y_n^m(\Omega_c)^\dagger\approx\frac{4\pi}{c}Y_n^m(\Omega_c)^* \tag{9}$$

becomes a valid expression.

Spherical Microphone Array Processing—Simulation of the Processing

A complete HOA processing chain for spherical microphone arrays on a rigid (stiff, fixed) sphere includes the estimation of the pressure at the capsules, the computation of the HOA coefficients and the decoding to the loudspeaker weights. The description of the microphone array in the spherical harmonics representation enables the estimation of the average spectral power at the point of origin for a given decoder. The power for the mode matching Ambisonics decoder and a simple beam forming decoder is evaluated. The estimated average power at the sweet spot is used to design an equalization filter.

The following section describes the decomposition of w(k) into the reference weight $w_{ref}(k)$, the spatial aliasing weight $w_{alias}(k)$ and a noise weight $w_{noise}(k)$. The aliasing is caused by the sampling of the continuous sound field for a finite order N and the noise simulates the spatially uncorrelated signal parts introduced for each capsule. The spatial aliasing cannot be removed for a given microphone array.

Spherical Microphone Array Processing—Simulation of Capsule Signals

The transfer function of an impinging plane wave for a microphone array on the surface of a rigid sphere is defined in section 2.2, equation (19) of the above-mentioned M. A. Poletti article:

$$b_n(kR)=\frac{4\pi i^{n+1}}{(kR)^2\left.\frac{dh_n^{(1)}(kr)}{dkr}\right|_{kr=kR}}, \tag{10}$$

where $h_n^{(1)}(kr)$ is the Hankel function of the first kind and the radius r is equal to the radius of the sphere R. The transfer function is derived from the physical principle of scattering the pressure on a rigid sphere, which means that the radial velocity vanishes on the surface of a rigid sphere. In other words, the superposition of the radial derivation of the incoming and the scattered sound field is zero, cf. section 6.10.3 of the "Fourier Acoustics" book. Thus, the pressure on the surface of the sphere at the position Ω for a plane wave impinging from $\Omega_s$ is given in section 3.2.1, equation (21) of the Moreau/Daniel/Bertet article by $$\begin{aligned}P(\Omega,kR)&=\sum_{n=0}^{\infty}\sum_{m=-n}^{n}b_n(kR)Y_n^m(\Omega)d_n^m(k)\\&=\sum_{n=0}^{\infty}\sum_{m=-n}^{n}b_n(kR)Y_n^m(\Omega)Y_n^m(\Omega_s)^*P_0(k).\end{aligned} \tag{11}$$

The isotropic noise signal $P_{noise}(\Omega_c,k)$ is added to simulate transducer noise, where 'isotropic' means that the noise signals of the capsules are spatially uncorrelated, which does not include the correlation in the temporal domain. The pressure can be separated into the pressure $P_{ref}(\Omega_c,kR)$ computed for the maximal order N of the microphone array and the pressure from the remaining orders, cf. section 7, equation (24) in the above-mentioned Rafaely "Analysis and design . . . " article. The pressure from the remaining orders $P_{alias}(\Omega_c,kR)$ is called the spatial aliasing pressure because the order of the microphone array is not sufficient to reconstruct these signal components. Thus, the total pressure recorded at the capsule c is defined by:

$$P(\Omega_c, kR) = P_{ref}(\Omega_c, kR) + P_{alias}(\Omega_c, kR) + P_{noise}(\Omega_c, k) \tag{12a}$$

$$= \sum_{n=0}^{N}\sum_{m=-n}^{n} b_n(kR)Y_n^m(\Omega_c)Y_n^m(\Omega_s)^* P_0(k) + \sum_{n=N+1}^{\infty}\sum_{m=-n}^{n} b_n(kR)Y_n^m(\Omega_c)Y_n^m(\Omega_s)^* P_0(k) + P_{noise}(\Omega_c, k). \tag{12b}$$

Spherical Microphone Array Processing—Ambisonics Encoding

The Ambisonics coefficients $d_n^m(k)$ are obtained from the pressure at the capsules by the inversion of equation (11) given in equation (13a), cf. section 3.2.2, equation (26) of the above-mentioned Moreau/Daniel/Bertet article. The spherical harmonics $Y_n^m(\Omega_c)$ is inverted by $Y_n^m(\Omega_c)^\dagger$ using equation (8), and the transfer function $b_n(kR)$ is equalized by its inverse:

$$d_n^m(k) = \sum_{c=1}^{C} \frac{Y_n^m(\Omega_c)^\dagger P(\Omega_c, kR)}{b_n(kR)} \tag{13a}$$

$$\sum_{c=1}^{C} \frac{Y_n^m(\Omega_c)^\dagger (P_{ref}(\Omega_c, kR) + P_{alias}(\Omega_c, kR) + P_{noise}(\Omega_c k))}{b_n(kR)} \tag{13b}$$

$$d_{n_{ref}}^m(k) + d_{n_{alias}}^m(k) + d_{n_{noise}}^m(k). \tag{13c}$$

The Ambisonics coefficients $d_n^m(k)$ can be separated into the reference coefficients $d_{n_{ref}}^m(k)$, the aliasing coefficients $d_{n_{alias}}^m(k)$ and the noise coefficients $d_{n_{noise}}^m(k)$ using equations (13a) and (12a) as shown in equations (13b) and (13c).

Spherical Microphone Array Processing—Ambisonics Decoding

The optimization uses the resulting loudspeaker weight w(k) at the point of origin. It is assumed that all speakers have the same distance to the point of origin, so that the sum over all loudspeaker weights results in w(k). Equation (14) provides w(k) from equations (1) and (13b), where L is the number of loudspeakers:

$$w(k) = \sum_{l=1}^{L}\sum_{n=0}^{N}\sum_{m=-n}^{n} D_n^m(\Omega_l) \times \sum_{c=1}^{C} \frac{Y_n^m(\Omega_c)^\dagger (P_{ref}(\Omega_c, kR)P_{alias}(\Omega_c, kR) + P_{noise}(\Omega_c, k))}{b_n(kR)} \tag{14a}$$

$$w_{ref} + w_{alias}(k) + w_{noise}(k). \tag{14b}$$

Equation (14b) shows that w(k) can also be separated into the three weights $w_{ref}(k)$, $w_{alias}(k)$ and $w_{noise}(k)$. For simplicity, the positioning error given in section 7, equation (24) of the above-mentioned Rafaely "Analysis and design . . . " article is not considered here.

In the decoding, the reference coefficients are the weights that a synthetically generated plane wave of order n would create. In the following equation (15a) the reference pressure $P_{ref}(\Omega_c,kR)$ from equation (12b) is substituted in equation (14a), whereby the pressure signals $P_{alias}(\Omega_c,kR)$ and $P_{noise}(\Omega_c,k)$ are ignored (i.e. set to zero):

$$w_{ref}(k) = \sum_{l=1}^{L}\sum_{n=0}^{N}\sum_{m=-n}^{n} D_n^m(\Omega_l) \times \sum_{n'=0}^{N}\sum_{m'=-n'}^{n'} Y_{n'}^{m'}(\Omega_s)^* \frac{b_{n'}(kR)}{b_n(kR)} \sum_{c=1}^{C} Y_n^m(\Omega_c)^\dagger Y_{n'}^{m'}(\Omega_c) P_0(k) \tag{15a}$$

$$= \sum_{l=1}^{L}\sum_{n=0}^{N}\sum_{m=-n}^{n} D_n^m(\Omega_l) Y_n^m(\Omega_s)^* P_0(k) \tag{15b}$$

$$= \sum_{l=1}^{L}\sum_{n=0}^{N}\sum_{m=-n}^{n} D_n^m(\Omega_l) d_{n_{plane}}^m(k)$$

The sums over c, n' and m' can be eliminated using equation (8), so that equation (15a) can be simplified to the sum of the weights of a plane wave in the Ambisonics representation from equation (3). Thus, if the aliasing and noise signals are ignored, the theoretical coefficients of a plane wave of order N can be perfectly reconstructed from the microphone array recording.

The resulting weight of the noise signal $w_{noise}(k)$ is given by $$w_{noise}(k) = \sum_{l=1}^{L}\sum_{n=0}^{N}\sum_{m=-n}^{n} D_n^m(\Omega_l) \times \sum_{c=1}^{C} \frac{Y_n^m(\Omega_c)^\dagger P_{noise}(\Omega_c, k)}{b_n(kR)} \tag{16}$$

from equation (14a) and using only $P_{noise}(\Omega_c,k)$ from equation (12b).

Substituting the term of $P_{alias}(\Omega_c,kR)$ from equation (12b) in equation (14a) and ignoring the other pressure signals results in:

$$w_{alias}(k) = \sum_{l=1}^{L}\sum_{n=0}^{N}\sum_{m=-n}^{n} D_n^m(\Omega_l) \times \sum_{n'=N+1}^{\infty}\sum_{m'=-n'}^{n'} Y_{n'}^{m'}(\Omega_s)^* \frac{b_{n'}(kR)}{b_n(kR)} \sum_{c=1}^{C} Y_n^m(\Omega_c)^\dagger Y_{n'}^{m'}(\Omega_c) P_0(k). \tag{17}$$

The resulting aliasing weight $w_{alias}(k)$ cannot be simplified by the orthonormal condition from equation (8) because the index n' is greater than N.

The simulation of the alias weight requires an Ambisonics order that represents the capsule signals with a sufficient accuracy. In section 2.2.2, equation (14) of the above-mentioned Moreau/Daniel/Bertet article an analysis of the truncation error for the Ambisonics sound field reconstruction is given. It is stated that for $$N_{opt} = ?\ ?\ \lceil kR \rceil \tag{18}$$

a reasonable accuracy of the sound field can be obtained, where '⌈•⌉' denotes the rounding-up to the nearest integer. This accuracy is used for the upper frequency limit $f_{max}$ of the simulation. Thus, the Ambisonics order of $$N_{max} = \left\lceil \frac{2\pi f_{max} R}{c_{sound}} \right\rceil \tag{19}$$

is used for the simulation of the aliasing pressure of each wave number. This results in an acceptable accuracy at the upper frequency limit, and the accuracy even increases for low frequencies.

Spherical Microphone Array Processing —Analysis of the Loudspeaker Weight

FIG. 1 shows the power of the weight components a) $w_{ref}(k)$, b) $w_{noise}(k)$ and c) $w_{alias}(k)$ from the resulting loudspeaker weight for a plain wave from direction $\Omega_s=[0,0]^T$ for a microphone array with 32 capsules on a rigid sphere (the Eigenmike from the above-mentioned Agmon/Rafaely article has been used for the simulation). The microphone capsules are uniformly distributed on the surface of the sphere with R=4.2 cm so that the orthonormal conditions are fulfilled. The maximal Ambisonics order N supported by this array is four. The mode matching processing as described in the above-mentioned M. A. Poletti article is used to obtain the decoding coefficients $D_n^m(\Omega_l)$ for 25 uniformly distributed loudspeaker positions according to Jörg Fliege, Ulrike Maier, "A Two-Stage Approach for Computing Cubature Formulae for the Sphere", Technical report, 1996, Fachbereich Mathematik, Universität Dortmund, Germany. The node numbers are shown at http://www.mathematik.uni-dortmund.de/1sx/research/projects/fliege/nodes/nodes.html.

The power of the reference weight $w_{ref}(k)$ is constant over the entire frequency range. The resulting noise weight $w_{noise}(k)$ shows high power at low frequencies and decreases at higher frequencies. The noise signal or power is simulated by a normally distributed unbiased pseudo-random noise with a variance of 20 dB (i.e. 20 dB lower than the power of the plane wave). The aliasing noise $w_{alias}(k)$ can be ignored at low frequencies but increases with rising frequency, and above 10 kHz exceeds the reference power. The slope of the aliasing power curve depends on the plane wave direction. However, the average tendency is consistent for all directions.

The two error signals $w_{noise}(k)$ and $w_{alias}(k)$ distort the reference weight in different frequency ranges. Furthermore, the error signals are independent of each other. Therefore a two-step equalization processing is proposed. In the first step, the noise signal is compensated using the method described in the European application with internal reference PD110039, filed on the same day by the same applicant and having the same inventors. In the second step, the overall signal power is equalized under consideration of the aliasing signal and the first processing step.

In the first step, the mean square error between the reference weight and the distorted reference weight is minimized for all incoming plane wave directions. The weight from the aliasing signal $w_{alias}(k)$ is ignored because $w_{alias}(k)$ cannot be corrected after having been spatially band-limited by the order of the Ambisonics representation. This is equivalent to the time domain aliasing where the aliasing cannot be removed from the sampled and band-limited time signal.

In the second step, the average power of the reconstructed weight is estimated for all plane wave directions. A filter is described below that balances the power of the reconstructed weight to the power of the reference weight. That filter equalizes the power only at the sweet spot. However, the aliasing error still disrupts the sound field representation for high frequencies.

The spatial frequency limit of a microphone array is called spatial aliasing frequency. The spatial aliasing frequency $$f_{alias} = \frac{c_{sound}}{2R0.73} \tag{20}$$

is computed from the distance of the capsules (cf. WO 03/061336 A1), which is approximately 5594 Hz for the Eigenmike with a radius R equal to 4.2 cm.

Optimization—Noise Reduction

The noise reduction is described in the above-mentioned European application with internal reference PD110039, where the signal-to-noise ratio SNR(k) between the average sound field power and the transducer noise is estimated. From the estimated SNR(k) the following optimization filter can be designed:

$$F_n(k) = \frac{|b_n(kR)|^2}{|b_n(kR)|^2 + \frac{(4\pi)^2}{CSNR(k)}} \tag{21}$$

The parameters of transfer function $F_n(k)$ depend on the number of microphone capsules and on the signal-to-noise ratio for the wave number k. The filter is independent of the Ambisonics decoder, which means that it is valid for three-dimensional Ambisonics decoding and directional beam forming. The SNR(k) can be obtained from the above-mentioned European application with internal reference PD110039. The filter is a high-pass filter that limits the order of the Ambisonics representation for low frequencies. The cut-off frequency of the filter decreases for a higher SNR(k). The transfer functions $F_n(k)$ of the filter for an SNR(k) of 20 dB are shown in FIGS. 2*a* to 2*e* for the Ambisonics orders zero to four, respectively, wherein the transfer functions have a highpass characteristic for each order n with increasing cut-off frequency to higher orders. The cut-off frequencies decay with the regularization parameter λ as described in section 4.1.2 in the above-mentioned Moreau/Daniel/Bertet article. Therefore, a high SNR(k) is required to obtain higher order Ambisonics coefficients for low frequencies.

The optimized weight w'(k) is computed from $$\begin{aligned} w'(k) = & \sum_{n=0}^{N} \sum_{m=-n}^{n} \sum_{l=1}^{L} D_n^m(\Omega_l) \times \\ & \frac{F_n(k)}{b_n(kR)} \sum_{c=1}^{C} Y_n^m(\Omega_c)^{\dagger} (P_{ref}(\Omega_c, kR) + \\ & P_{alias}(\Omega_c, kR) + P_{noise}(\Omega_c, k)) \\ = & w'_{ref}(k) + w'_{alias}(k) + w'_{noise}(k). \end{aligned} \tag{22}$$

The resulting average power of $w'_{noise}(k)$ is evaluated in the following section.

Optimization—Spectral Power Equalization

The average power of the optimized weight w'(k) is obtained from its squared magnitude expectation value. The noise weight $w'_{noise}(k)$ is spatially uncorrelated to the weights $w'_{ref}(k)$ and $w'_{alias}(k)$ so that the noise power can be computed independently as shown in equation (23a). The power of the reference and aliasing weight are derived from equation (23b). The combination of the equations (22), (15a) and (17) results in equation (23c), where $w'_{noise}(k)$ is ignored in equation (22). The expansion of the squared magnitude simplifies equations (23c) and (23d) using equation (4).

$$E\{|w'(k)|^2\} = E\{|w'_{ref}(k) + w'_{alias}(k)|^2\} + E\{|w'_{noise}(k)|^2\} \tag{23a}$$

$$E\{|w'_{ref}(k) + w'_{alias}(k)|^2\} = \frac{1}{4\pi}\int_{\Omega_s \in S^2} |w'_{ref}(k) + w'_{alias}(k)|^2 \, d\Omega_s \tag{23b}$$

$$= \frac{1}{4\pi}\int_{\Omega_s \in S^2} \left| \sum_{n=0}^{N} \sum_{m=-n}^{n} \sum_{l=1}^{L} D_n^m(\Omega_l) \times \sum_{n'=0}^{\infty} \sum_{m'=-n'}^{n'} Y_{n'}^{m'}(\Omega_s)^* \frac{F_n(k) b_{n'}(kR)}{b_n(kR)} \sum_{c=1}^{C} Y_n^m(\Omega_c)^\dagger Y_{n'}^{m'}(\Omega_c) P_0(k) \right|^2 d\Omega_s \tag{23c}$$

$$= \frac{|P_0(k)|^2}{4\pi} \sum_{n'=0}^{\infty} \sum_{m'=-n'}^{n'} \left| \sum_{n=0}^{N} \sum_{m=-n}^{n} \sum_{l=1}^{L} D_n^m(\Omega_l) \times \frac{F_n(k) b_{n'}(kR)}{b_n(kR)} \sum_{c=1}^{C} Y_n^m(\Omega_c)^\dagger Y_{n'}^{m'}(\Omega_c) \right|^2 \tag{23d}$$

$$E\{|w'_{noise}(k)|^2\} = \frac{4\pi}{C} \sum_{n=0}^{N} \sum_{m=-n}^{n} \frac{\left|\sum_{l=1}^{L} D_n^m(\Omega_l)\right|^2 |P_{noise}(k)|^2 |F_n(k)|^2}{|b_n(kR)|^2} \tag{23e}$$

The power of the optimized error weight $w'_{noise}(k)$ is given in equation (23e). The derivation of $E\{|w'_{noise}(k)|_2\}$ is described in the above-mentioned European application with internal reference PD110039.

The resulting power depends on the used decoding processing. However, for conventional three-dimensional Ambisonics decoding it is assumed that all directions are covered by the loudspeaker arrangement. In this case the coefficients with an order greater than zero are eliminated by the sum of the decoding coefficients $D_n^m(\Omega_l)$ given in equation (23). This means that the pressure at the point of origin is equivalent to the zero order signal so that the missing higher order coefficients at low frequencies do not reduce the power at the sweet spot.

This is different for beam forming of the Ambisonics representation because only sound from a specific direction is reconstructed. Here one loudspeaker is used so that all coefficients of $D_n^m(\Omega_l)$ are contributing to the power at the point of origin. Thus the extenuated higher order coefficients for low frequencies are changing the power of the weight w'(k) compared to the high frequencies.

This can be perfectly explained for the power of the reference weight given in equation (24) by changing the order N:

$$E\{|w_{ref}(k)|^2\} = \frac{|P_0(k)|^2}{4\pi} \sum_{n=0}^{N} \sum_{m=-n}^{n} \left|\sum_{l=1}^{L} D_n^m(\Omega_l)\right|^2. \tag{24}$$

The derivation of equation (24) is provided in the above-mentioned European application with internal reference PD110039. The power is equivalent to the sum of the squared magnitudes of $D_n^m(\Omega_l)$, so that for one loudspeaker l the power increases with the order N.

However, for Ambisonics decoding the sum of all loudspeaker decoding coefficients $D_n^m(\Omega_l)$ removes the higher order coefficients so that only the zero order coefficients are contributing to the power at the sweet spot. Thus the missing HOA coefficients at low frequencies change the power of w'(k) for beam forming but not for Ambisonics decoding.

The average power components of w'(k), obtained from the noise optimization filter, are shown in FIG. 3 for conventional Ambisonics decoding. FIG. 3*b* shows the reference+alias power, FIG. 3*c* shows the noise power and FIG. 3*a* the sum of both. The noise power is reduced to −35 dB up to a frequency of 1 kHz. Above 1 kHz the noise power increases linearly to −10 dB. The resulting noise power is smaller than $P_{noise}(\Omega_c, k)$=−20 dB up to a frequency of 8 kHz. The total power is raised by 10 dB above 10 kHz, which is caused by the aliasing power. Above 10 kHz the HOA order of the microphone array does not sufficiently describe the pressure distribution on the surface for the sphere with a radius equal to R. As a result the average power caused by the obtained Ambisonics coefficients is greater than the reference power.

FIG. 4 shows the power components of w'(k) for decoding coefficients $D_n^m(\Omega_l)=Y_n^m(\Omega_{[0,0]^T})$ for L=1. This can be interpreted as beam forming in the direction $\Omega=[0,0]^T$, as shown in the above-mentioned Agmon/Rafaely article. FIG. 4*b* shows the reference+alias power, FIG. 4*c* shows the noise power and FIG. 4*a* the sum of both. The power increases from low to high frequencies, stays nearly constant from 3 kHz to 6 kHz and increases then again significantly. The first increase is caused by the extenuation of the higher order coefficients because 3 kHz is approximately the cut-off frequency of $F_n(k)$ for the fourth order coefficients shown in FIG. 2*e*. The second increase is caused by the spatial aliasing power as discussed for the Ambisonics decoding.

Now, an equalization filter for the average power of w'(k) is determined. This filter strongly depends on the used decoding coefficients $D_n^m(\Omega_l)$, and can therefore be used only if these decoding coefficients $D_n^m(\Omega_l)$ are known.

For conventional Ambisonics decoding the assumption $$\Sigma_{l=1}^{L} D_n^m(\Omega_l)=\delta_n\delta_m \tag{25}$$

can be made. However, it is to be assured that the applied Ambisonics decoders will nearly fulfil that assumption.

The real-valued equalization filter $F_{EQ}(k)$ is given in equation (26a). It compensates the average power of w'(k) to the reference power of $w_{ref}(k)$. In equation (26b) equations (23e) and (27) are used to show in equation (26b) that $F_{EQ}(k)$ is also a function of the SNR(k).

$$E\{|w_{ref}(k)|^2\}=E\{|F_{EQ}(k)(w'_{ref}(k)+w'_{alias}(k))|^2\}$$
$$E\{|F_{EQ}(k)w'_{noise}(k)|^2\}$$

$$E\{|w_{ref}(k)|^2\} = E\{|F_{EQ}(k)(w'_{ref}(k)+w'_{alias}(k))|^2\}+E\{|F_{EQ}(k)w'_{noise}(k)|^2\}$$

$$F_{EQ}(k)=\sqrt{\frac{E\{|w_{ref}(k)|^2\}}{E\{|w'_{ref}(k)+w'_{alias}(k)|^2\}+E\{|w'_{noise}(k)|^2\}}} \tag{26a}$$

$$=\sqrt{\frac{|P_0(k)|^2E\{|w_{ref}(k)|^2\}}{|P_0(k)|^2E\{|w'_{ref}(k)+w'_{alias}(k)|^2\}+\frac{4\pi}{C}\sum_{n=0}^{N}\sum_{m=-n}^{n}\frac{\left|\sum_{l=1}^{L}D_n^m(\Omega_l)\right|^2|P_{noise}(k)|^2|F_n(k)|^2}{|b_n(kR)|^2}}} \tag{26b}$$

$$=\sqrt{\frac{E\{|w_{ref}(k)|^2\}}{E\{|w'_{ref}(k)+w'_{alias}(k)|^2\}+\frac{4\pi}{C}\sum_{n=0}^{N}\sum_{m=-n}^{n}\frac{\left|\sum_{l=1}^{L}D_n^m(\Omega_l)\right|^2|F_n(k)|^2}{|b_n(kR)|^2SNR(k)}}} \tag{26c}$$

$$|P_0(k)|^2E\{|w'(k)|^2\}=E\{|w(k)|^2\} \tag{27}$$

The problem is that the filter $F_{EQ}(k)$ depends on the filter $F_n(k)$ so that for each change of the SNR(k) both filter have to be re-designed. The computational complexity of the filter design is high due to the high Ambisonics order that is used to simulate the power of the aliasing and reference error $E\{|w'_{ref}(k)+w'_{alias}(k)|^2\}$. For adaptive filtering this complexity can be reduced by performing the computational complex processing only once in order to create a set of constant filter design coefficients for a given microphone array. In equations (28) the derivation of these filter coefficients is provided.

$$A_{n'm}^{m'}=\sum_{l=1}^{L}\sum_{m=-n}^{n}D_n^m(\Omega_l)\times\frac{b_{n'}(kR)}{b_n(kR)}\sum_{c=1}^{C}Y_n^m(\Omega_c)^{\dagger}Y_{n'}^{m'}(\Omega_c) \tag{28a}$$

$$E\{|w'_{ref}(k)+w'_{alias}(k)|^2\}=\frac{1}{4\pi}\sum_{n'=0}^{\infty}\sum_{m'=-n'}^{n'}\sum_{n=0}^{N}\sum_{n''=0}^{N}F_n(k)A_{n'n}^{m'}F_{n''}(k)^*A_{n'n''}^{m'*} \tag{28b}$$

$$=\frac{1}{4\pi}\sum_{n=0}^{N}\sum_{n''=0}^{N}F_{n''}(k)^*F_n(k)\sum_{n'=0}^{\infty}\sum_{m'=-n}^{n'}A_{n'n}^{m'}A_{n'n''}^{m'*}= \tag{28c}$$

-continued $$\frac{1}{4\pi}\sum_{n=0}^{N}\sum_{n''=n}^{N}\begin{cases}F_{n''}(k)^*F_n(k)\sum_{n'=0}^{\infty}\sum_{m'=-n}^{n'}A_{n'n}^{m'}A_{n'n''}^{m'*}, & \text{for } n=n''\\ 2\,\text{real}\left\{F_{n''}(k)^*F_n(k)\sum_{n'=0}^{\infty}\sum_{m'=-n'}^{n'}A_{n'n}^{m'}A_{n'n''}^{m'*}\right\}, & \text{else}\end{cases} \tag{28d}$$

In equation (28d) it is shown that the highly complex computation of $E\{|w'_{ref}(k)+w'_{alias}(k)|^2\}$ can be separated into the sums of n from zero to N and the dependent sum over n" from n to N. Each element of these sums is a multiplication of the filter $F_n(k)$, its conjugated complex value, the infinite sums over n' and m' of the product of $A_{n'n}^{m'}$, and its conjugated complex value. The infinite sums are approximated by the finite sums running to $n'=N_{max}$. The results of these sums give the constant filter design coefficients for each combination of n and n". These coefficients are computed once for a given array and can be stored in a look-up table for a time-variant signal-to-noise ratio adaptive filter design.

Optimization—Optimized Ambisonics Processing

In the practical implementation of the Ambisonics microphone array processing, the optimized Ambisonics coefficients $d_{n_{opt}}^m(k)$ are obtained from $$d_{n\,opt}^m(k)=\frac{F_{EQ}(k)F_n(k)}{b_n(kR)}\sum_{c=1}^{C}Y_n^m(\Omega_c)^{\dagger}P(\Omega_c,kR), \tag{29}$$

which includes the sum over the capsules c and an adaptive transfer function for each order n and wave number k. That sum converts the sampled pressure distribution on the surface of the sphere to the Ambisonics representation, and for wideband signals it can be performed in the time domain. This processing step converts the time domain pressure signals $P(\Omega_c,t)$ to the first Ambisonics representation $A_n^m(t)$.

In the second processing step the optimized transfer function $$F_{n,array}(k)=\frac{F_{EQ}(k)F_n(k)}{b_n(kR)} \tag{30}$$

reconstructs the directional information items from the first Ambisonics representation $A_n^m(t)$. The reciprocal of the transfer function $b_n(kR)$ converts $A_n^m(t)$ to the directional coefficients $d_n^m(t)$, where it is assumed that the sampled sound field is created by a superposition of plane waves that were scattered on the surface of the sphere. The coefficients $d_n^m(t)$ are representing the plane wave decomposition of the sound field described in section 3, equation (14) of the above-mentioned Rafaely "Plane-wave decomposition . . . " article, and this representation is basically used for the transmission of Ambisonics signals. Dependent on the SNR(k), the optimization transfer function $F_n(k)$ reduces the contribution of the higher order coefficients in order to remove the HOA coefficients that are covered by noise. The power of the reconstructed signal is equalized by the filter $F_{EQ}(k)$ for a known or assumed decoder processing.

The second processing step results in a convolution of $A_n^m(t)$ with the designed time domain filter. The resulting optimized array responses for the conventional Ambisonics decoding are shown in FIG. 5, and the resulting optimized array responses for the beam forming decoder example are shown in FIG. 6. In both figures, transfer functions a) to e) correspond to Ambisonics order 0 to 4, respectively.

The processing of the coefficients $A_n^m(t)$ can be regarded as a linear filtering operation, where the transfer function of the filter is determined by $F_{n,array}(k)$. This can be performed in the frequency domain as well as in the time domain. The FFT can be used for transforming the coefficients $A_n^m(t)$ to the frequency domain for the successive multiplication by the transfer function $F_{n,array}(k)$. The inverse FFT of the product results in the time domain coefficients $d_n^m(t)$. This transfer function processing is also known as the fast convolution using the overlap-add or overlap-save method.

Alternatively, the linear filter can be approximated by an FIR filter, whose coefficients can be computed from the transfer function $F_{n,array}(k)$ by transforming it to the time domain with an inverse FFT, performing a circular shift and applying a tapering window to the resulting filter impulse response to smooth the corresponding transfer function. The linear filtering process is then performed in the time domain by a convolution of the time domain coefficients of the transfer function $F_{n,array}(k)$ and the coefficients $A_n^m(t)$ for each combination of n and m.

The inventive adaptive block based Ambisonics processing is depicted in FIG. 7. In the upper signal path, the time domain pressure signals $P(\Omega_c,t)$ of the microphone capsule signals are converted in step or stage 71 to the Ambisonics representation $A_n^m(t)$ using equation (13a), whereby the division by the microphone transfer function $b_n(kR)$ is not carried out (thereby $A_n^m(t)$ is calculated instead of $d_n^m(k)$), and is instead carried out in step/stage 72. Step/stage 72 performs then the described linear filtering operation in the time domain or frequency domain in order to obtain the coefficients $d_n^m(t)$, whereby the microphone array response is removed from $AA_n^m(t)$. The second processing path is used for an automatic adaptive filter design of the transfer function $F_{n,array}(k)$. The step/stage 73 performs the estimation of the signal-to-noise ratio SNR(k) for a considered time period (i.e. block of samples). The estimation is performed in the frequency domain for a finite number of discrete wave numbers k. Thus the regarded pressure signals $P(\Omega_c,t)$ have to be transformed to the frequency domain using for example an FFT. The SNR(k) value is specified by the two power signals $|P_{noise}(k)|^2$ and $|P_0(k)|^2$. The power $|P_{noise}(k)|^2$ of the noise signal is constant for a given array and represents the noise produced by the capsules. The power $|P_0(k)|^2$ of the plane wave is estimated from the pressure signals $P(\Omega_c,t)$. The estimation is further described in section SNR estimation in the above-mentioned European application with internal reference PD110039. From the estimated SNR(k) the transfer function $F_{n,array}(k)$ with $n \leq N$ is designed in step/stage 74 in the frequency domain using equations (30), (26c), (21) and (10). The filter design can use a Wiener filter and the inverse array response or inverse transfer function $1/b_n(kR)$. The filter implementation is then adapted to the corresponding linear filter processing in the time or frequency domain of step/stage 72.

The results of the inventive processing are discussed in the following. Therefore, the equalization filter $F_{EQ}(k)$ from equation (26c) is applied to the expectation value $E\{|w'(k)|^2\}$. The resulting power of $E\{|w'(k)|^2\}$, the reference power $E\{|w_{ref}(k)|^2\}$ and the resulting noise power for the examples of the conventional Ambisonics decoding from FIG. 3 and the beam forming from FIG. 4 are discussed. The resulting power spectra for a conventional Ambisonics decoder are depicted in FIG. 8, and for the beam forming decoder in FIG. 9, wherein curves a) to c) show $|w_{opt}|^2$, $|w_{ref}|^2$ and $|w_{noise}|^2$, respectively.

The power of the reference and the optimized weight are identical so that the resulting weight has a balanced frequency spectrum. At low frequencies the resulting signal-to-noise ratio at the sweet spot has increased for the conventional Ambisonics decoding and decreased for the beam forming decoding, compared to the given SNR(k) of 20 db. At high frequencies the signal-to-noise ratio is equal to the given SNR(k) for both decoders. However, for the beam forming decoding the SNR at high frequencies is greater with respect to that at low frequencies, while for the Ambisonics decoder the SNR at high frequencies is smaller with respect to that at low frequencies. The smaller SNR at low frequencies of the beam forming decoder is caused by the missing higher order coefficients. In FIG. 9 the average noise power is reduced compared to that in FIG. 1. On the other hand, the signal power has also decreased at low frequencies due to the missing higher order coefficients as discussed in section Optimization—spectral power equalization. As a result the distance between the signal and the noise power becomes smaller.

Furthermore, the resulting SNR strongly depends on the used decoding coefficients $D_n^m(\Omega_l)$. Example beam pattern is a narrow beam pattern that has strong high order coefficients. Decoding coefficients that produce beam pattern with wider beams can increase the SNR. These beams have strong coefficients in the low orders. Better results can be achieved by using different decoding coefficients for several frequency bands in order to adapt to the limited order at low frequencies.

Other methods for optimized beam forming exist that minimize the resulting SNR, wherein the decoding coefficients $D_n^m(\Omega_l)$ are obtained by a numerical optimization for a specific steering direction. The optimal modal beam forming presented in Y. Shefeng, S. Haohai, U. P. Svensson, M. Xiaochuan, J. M. Hovem, "Optimal Modal Beamforming for Spherical Microphone Arrays", IEEE Transactions on Audio, Speech, and language processing, vol.19, no.2, pages 361-371, February 2011, and the maximum directivity beam forming discussed in M. Agmon, B. Rafaely, J. Tabrikian, "Maximum Directivity Beamformer for Spherical-Aperture Microphones", 2009 IEEE Workshop on Applcations of Signal Processing to Audio and Acoustics WASPAA '09, Proc. IEEE International Conference on Acoustics, Speech, and Signal Processing, pages 153-156, 18-21 Oct. 2009, New Paltz, N.Y., USA, are two examples for optimized beam forming.

The example Ambisonics decoder uses mode matching processing, where each loudspeaker weight is computed from the decoding coefficients used in the beam forming example. The decoding coefficients for the loudspeaker at $\Omega_c$ are defined by $D_n^m(\Omega_l)=Y_n^m(\Omega_{\Omega_c})$ because the loudspeakers are uniformly distributed on the surface of a sphere. The loudspeaker signals have the same SNR as for the beam forming decoder example. However, on one hand the superposition of the loudspeaker signals at the point of origin results in an excellent SNR. On the other hand, the SNR becomes lower if the listening position moves out of the sweet spot.

The results show that the described optimization is producing a balanced frequency spectrum with an increased SNR at the point of origin for a conventional Ambisonics decoder, i.e. the inventive time-variant adaptive filter design is advantageous for Ambisonics recordings. The inventive procesing can also be used for designing a time-invariant filter if the SNR of the recording can be assumed constant over the time.

For beam forming decoders the inventive procesing can balance the resulting frequency spectrum, with the drawback of a low SNR at low frequencies. The SNR can be increased by selecting appropriate decoding coefficients that produce wider beams, or by adapting the beam width on the Ambisonics order of different frequency sub-bands.

The present principles are applicable to all spherical microphone recordings in the spherical harmonics representation, where the reproduced spectral power at the point of origin is unbalanced due to aliasing or missing spherical harmonic coefficients.

The invention claimed is:

1. A method for processing microphone capsule signals of a spherical microphone array on a rigid sphere, said method comprising:

converting said microphone capsule signals representing a pressure on the surface of said microphone array to a spherical harmonics or Ambisonics representation $A_n^m(t)$;

computing per wave number k an estimation of the time-variant signal-to-noise ratio SNR(k) of said microphone capsule signals, using the average source power $|P_0(k)|^2$ of the plane wave recorded from said microphone array and the corresponding noise power $|P_{noise}(k)|^2$ representing the spatially uncorrelated noise produced by analog processing in said microphone array;

computing per wave number k the average spatial signal power at the point of origin for a diffuse sound field, using reference, aliasing and noise signal power components, and forming the frequency response of an equalization filter from the square root of the fraction of a given reference power and said average spatial signal power at the point of origin, and multiplying per wave number k said frequency response of said equalization filter by a transfer function, for each order n at discrete finite wave numbers k, of a noise minimizing filter derived from said estimation of the time-variant signal-to-noise ratio estimation SNR(k), and by an inverse transfer function of said microphone array, in order to get an adapted transfer function $F_{n,array}(k)$;

applying said adapted transfer function $F_{n,array}(k)$ to said spherical harmonics or Ambisonics representation $A_n^m(t)$ using a linear filter processing, resulting in adapted directional time domain coefficients $d_n^m(t)$, wherein n denotes the Ambisonics order and index n runs from 0 to a finite order and m denotes the degree and index m runs from −n to n for each index n.

2. The method of claim 1, wherein said noise power $|P_{noise}(k)|^2$ is obtained in a silent environment without any sound sources so that $|P_0(k)|^2=0$.

3. The method of claim 1, wherein said average source power $|P_0(k)|^2$ is estimated from the pressure $P_{mic}(\Omega_c,k)$ measured at the microphone capsules by a comparison of the expectation value of the pressure at the microphone capsules and the measured average signal power at the microphone capsules.

4. The method of claim 1, wherein said transfer function $F_{n,array}(k)$ of the array is determined in the frequency domain comprising:

transforming the coefficients of the spherical harmonics or Ambisonics representation $A_n^m(t)$ to the frequency domain using an Fast Fourier Transform (FFT), followed by multiplication by said transfer function $F_{n,array}(k)$;

performing an inverse Fast Fourier Transform (FFT) of the product to get the directional time domain coefficients $d_n^m(t)$, or, approximation by an Finite Impulse Response (FIR) filter in the time domain, comprising performing an inverse Fast Fourier Transform (FFT);

performing a circular shift;

applying a tapering window to the resulting filter impulse response in order to smooth the corresponding transfer function;

performing a convolution of the resulting filter coefficients and the coefficients of the spherical harmonics or Ambisonics representation $A_n^m(t)$ for each combination of n and m.

5. The method of claim 1, wherein the transfer function of said equalization filter is determined by $$F_{EQ}(k) = \sqrt{\frac{E\{|w_{ref}(k)|^2\}}{E\{|w'_{ref}(k) + w'_{alias}(k)|^2\} + E\{|w'_{noise}(k)|^2\}}},$$

wherein E denotes an expectation value, $w_{ref}(k)$ is the reference weight for wave number k, $w'_{ref}(k)$ is the optimized reference weight for wave number k, $w'_{alias}(k)$ is the optimized alias weight for wave number k and $w'_{noise}(k)$ is the optimized noise weight for wave number k, whereby 'optimized' means noise reduced with respect to the noise arising in said spherical microphone array.

6. An apparatus for processing microphone capsule signals of a spherical microphone array on a rigid sphere, said apparatus including:

means for converting said microphone capsule signals representing the pressure on the surface of said microphone array to a spherical harmonics or Ambisonics representation $A_n^m(t)$;

means for computing per wave number k an estimation of the time-variant signal-to-noise ratio SNR(k) of said microphone capsule signals, using the average source power $|P_0(k)|^2$ of the plane wave recorded from said microphone array and the corresponding noise power $|P_{noise}(k)|^{2-}$ representing the spatially uncorrelated noise produced by analog processing in said microphone array;

means for computing per wave number k the average spatial signal power at the point of origin for a diffuse sound field, using reference, aliasing and noise signal power components, and for forming the frequency response of an equalization filter from the square root of the fraction of a given reference power and said average spatial signal power at the point of origin, and for multiplying per wave number k said frequency response of said equalization filter by a transfer function, for each order n at discrete finite wave numbers k, of a noise minimizing filter derived from said estimation of the time-variant signal-to-noise ratio SNR(k), and by an inverse transfer function of said microphone array, in order to get an adapted transfer function $F_{n,array}(k)$;

means for applying said adapted transfer function $F_{n,array}(k)$ to said spherical harmonics or Ambisonics representation $A_n^m(t)$ using a linear filter processing, resulting in adapted directional time domain coefficients $d_n^m(t)$, wherein n denotes the Ambisonics order and index n runs from 0 to a finite order and m denotes the degree and index m runs from −n to n for each index n.

7. The apparatus of claim 6, wherein said noise power $|P_{noise}(k)|_2$ is obtained in a silent environment without any sound sources so that $|P_0(k)|^2=0$.

8. The apparatus of claim 6, wherein said average source power $|P_0(k)|^2$is estimated from the pressure $P_{mic}(\Omega_c,k)$ measured at the microphone capsules by a comparison of the expectation value of the pressure at the microphone capsules and the measured average signal power at the microphone capsules.

9. The apparatus of claim 6, wherein said transfer function $F_{n,array}(k)$ of the array is determined in the frequency domain comprising:

transforming the coefficients of the spherical harmonics or Ambisonics representation $A_n^m(t)$ to the frequency domain using a Fast Fourier Transform (FFT), followed by multiplication by said transfer function $F_{n,array}(k)$;

performing an inverse Fast Fourier Transform (FFT) of the product to get the directional time domain coefficients $d_n^m(t)$, or, approximation by a Finite Impulse Response (FIR) filter in the time domain, comprising performing an inverse Fast Fourier Transform (FFT);

performing a circular shift;

applying a tapering window to the resulting filter impulse response in order to smooth the corresponding transfer function;

performing a convolution of the resulting filter coefficients and the coefficients of the spherical harmonics or Ambisonics representation $A_n^m(t)$ for each combination of n and m.

10. The apparatus of claim 6, wherein the transfer function of said equalization filter is determined by $$F_{EQ}(k) = \sqrt{\frac{E\{|w_{ref}(k)|^2\}}{E\{|w'_{ref}(k) + w'_{alias}(k)|^2\} + E\{|w'_{noise}(k)|^2\}}},$$

wherein E denotes an expectation value, $w_{ref}(k)$ is the reference weight for wave number k, $w'_{ref}(k)$ is the optimized reference weight for wave number k, $w'_{alias}(k)$ is the optimized alias weight for wave number k and $w'_{noise}(k)$ is the optimized noise weight for wave number k, whereby 'optimized' means noise reduced with respect to the noise arising in said spherical microphone array.

* * * * *